US008945693B2

(12) United States Patent
Niu et al.

(10) Patent No.: US 8,945,693 B2
(45) Date of Patent: Feb. 3, 2015

(54) PRINTABLE ARTICLES INCLUDING COATING/INK-RECEIVING LAYERS AND METHODS OF PREPARATION THEREOF

(75) Inventors: Bor-Jiunn Niu, San Diego, CA (US); Dheya Alfekri, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1656 days.

(21) Appl. No.: 11/784,818

(22) Filed: Apr. 10, 2007

(65) Prior Publication Data

US 2008/0254240 A1 Oct. 16, 2008

(51) Int. Cl.

| | |
|---|---|
| ***B41M 5/00*** | (2006.01) |
| ***B41M 5/52*** | (2006.01) |
| *B41M 5/50* | (2006.01) |

(52) U.S. Cl.

CPC ..... *B41M 5/52* (2013.01); *B41M 5/502* (2013.01); *B41M 5/506* (2013.01); *B41M 5/508* (2013.01); *B41M 5/5218* (2013.01); *B41M 5/5254* (2013.01); *B41M 2205/38* (2013.01)

USPC ..... 428/32.16; 428/32.24; 428/32.25; 428/32.27; 428/32.28; 428/32.34; 428/32.37

(58) Field of Classification Search

CPC ..... B41M 5/52; B41M 5/502; B41M 5/506; B41M 5/508; B41M 5/5218; B41M 5/5254; B41M 2205/38

USPC ..... 428/32.16, 32.24, 32.25, 32.27, 32.28, 428/32.34, 32.37

See application file for complete search history.

(56) References Cited

U.S. PATENT DOCUMENTS

| | | | |
|---|---|---|---|
| 5,194,317 | A | 3/1993 | Sato et al. |
| 2005/0048230 | A1 | 3/2005 | Dalvey et al. |
| 2006/0045999 | A1 | 3/2006 | Chen et al. |
| 2006/0046030 | A1 | 3/2006 | Shiba |

FOREIGN PATENT DOCUMENTS

| | | |
|---|---|---|
| EP | 0515060 | 11/1992 |
| EP | 1609611 | 12/2005 |
| EP | 1403089 B1 | 8/2006 |

OTHER PUBLICATIONS

Hewlett-Packard Development Company, L.P., Extended European Search Report for Application No./Patent No. 08745305.6-2304/2137000 PCT/US2008059670, issued Mar. 18, 2011.

*Primary Examiner* — Betelhem Shewareged

(57) ABSTRACT

Printable articles having a single coating/ink receiving layer are disclosed. In addition, printable articles having a single coating/ink receiving layer disposed on the printable article and a second coating layer disposed on the coating/ink receiving layer are disclosed.

13 Claims, No Drawings

PRINTABLE ARTICLES INCLUDING COATING/INK-RECEIVING LAYERS AND METHODS OF PREPARATION THEREOF

BACKGROUND

Printing on textiles has grown over the past few years. However, dye ink printing remains a problem since dye inks do not last long on textiles and are very easily washed off. Conventional canvas structure for inkjet printing application is that the raw canvas textile, due to its surface characteristics, is coated with a "gesso" layer to give it whiteness and provide a surface that can be overcoated with an inkjet receptive coating. This makes the production a two-step coating operation. It is often to calendar the gesso coating for smoothness and adhesion before the inkjet receptor layer is applied.

SUMMARY

Briefly described, embodiments of this disclosure include printable articles. One exemplary printable article, among others, includes a single coating/ink receiving layer disposed on a surface of a substrate, wherein the coating/ink receiving layer includes a plurality of hollow beads and a binder.

Another exemplary printable article, among others, includes: a coating/ink receiving layer disposed on a surface of a substrate, wherein the coating/ink receiving layer includes a plurality of hollow beads and a binder; and a second layer disposed on top of the coating/ink receiving layer, wherein the second layer includes an inorganic pigment and a binder.

DETAILED DESCRIPTION

Embodiments of the present disclosure will employ, unless otherwise indicated, techniques of synthetic organic chemistry, ink chemistry, media chemistry, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an" and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Printable articles including a substrate having a coating/ink-receiving layer disposed thereon and methods of making coating/ink-receiving layers are described. The coating/ink-receiving layer can include, but is not limited to, a layer of hollow beads (e.g., latex beads) and a binder (e.g., latex binder). Ink can be dispensed onto the coating/ink-receiving layer to provide good durability as well as image quality. In addition, disposing the coating/ink-receiving layer onto the substrate (e.g., canvas or fabric) is simplified and less expensive than prior solutions. Furthermore, the finish of the printable article (e.g., canvas or fabric) is satin as compared to a matte finish of canvas with two layers. In an embodiment, the finished printable article product will have a good whiteness generated by hollow latex pigments without incorporating additional pigments such as $TiO_2$ or $CaCO_3$ pigments.

For example, to print on canvas, two layers (e.g., a Gesso layer and an ink-receiving layer) are used, where each layer was formed by a different processes and/or different vendors. The two layers make the process and product more expensive and the process for forming these two layers is much more complicated than the single coating/ink-receiving layer of the present disclosure. In the past, single layer coating technology was not capable to provide all the required attributes such as good whiteness, ink absorption capacity, image quality, and the like, in one coated layer structure.

In particular, embodiments of the present disclosure are directed to printable articles comprising a substrate usable in an inkjet printing apparatus (either or both piezoelectric and thermal inkjet, or other forms of inkjet printing). The substrate can include, but is not limited to, porous materials, fabrics, canvas, fiberglass, and the like. In an embodiment, the printable article includes a base substrate or medium and an image enhancing material that is present as either or both a layer disposed adjacent to the base medium and within the material from which the base medium is formed. According to an embodiment, the base medium includes, but is not limited to, porous media (e.g., fabrics, cotton bond, canvas, and rice paper); and fiberglass. In an embodiment, the substrate is formed from woven materials and/or formed from fibrous materials (e.g., cellulose or glass containing fibers). For example, the substrate can be a canvas material and/or fiberglass. As used herein, woven refers to a medium formed, at least in part, from interlaced strands or fibers.

Fabrics can include, but are not limited to, natural and synthetic fabrics as well as natural and synthetic fibrous material. Fabrics can include, but are not limited to, woven, nonwoven, and knitted fabrics. Fabrics can include, but are not limited to, woven and nonwoven canvas, cloth, cotton, hemp, rope, flax, linen, wool, rayon, nylon, polyester, natural and artificial silk, acetate, polyamide, denim, blends thereof, and combinations thereof. In particular, fabrics can include woven and nonwoven canvas.

The substrate may be from about 0.100 mm to 1.000 mm thick, depending on the desired end application. In an embodiment, the canvas, fabric, or printable article may be from about 0.150 mm to 0.750 mm thick, depending on the desired end application.

As mentioned above, an embodiment of the printable article includes the substrate and the single coating/ink receiving layer disposed on the substrate. The coating/ink receiving layer includes a layer of hollow beads bound together by a binder. The coating/ink receiving layer is from about 20 to 30 and from about 100 to 120 grams per square meter (GSM). The coating/ink receiving layer has a thickness of about 0.02 mm to 0.2 mm.

The coating/ink receiving layer is disposed directly onto the substrate without a gesso layer. The coating/ink receiving layer is configured to receive ink (dye and/or pigment), at least in part, by interactions between the ink and the hollow beads and/or the binder. In addition, the ink is received within the pores provided by the hollow beads, and by the space between hollow beads.

The binder or binder material used to bind the hollow beads together can include, but is not limited to, water soluble polymers (e.g., polyvinyl alcohol, cationic polyvinylalcohol, acetoacetylated polyvinylalcohol, silylated polyvinylalcohol, carboxylated polyvinylalcohol, poly (vinylalcohol-ethylene oxide) copolymer, polyvinylpyrrolidone, copolymer of poly(vinylacetate vinylpyrrolidone), copolymer of poly(vinylalcohol-vinylpyrrolidone), cationic polyvinylpyrrolidone, gelain, hydroxyethylcellulose, methyl cellulose), water dispersible polymers, and emulsion polymers (e.g., styrene butadiene copolymers, styrene acrylic copolymers, styrene methacrylic copolymers, styrene acrylic methacrylic copolymers vinyl acrylic polymers, all acrylic polymers, all methacrylic polymers, polyurethane dispersions, polyester dispersions, and combinations thereof). In an embodiment, the binder is a latex binder (e.g., the latex binder includes acrylic polymers, methacrylic polymers, styrene-acrylic copolymers, styrene-methacrylic copolymers, styrene-acrylic-methacrylic copolymers, and combinations thereof).

The term "hollow bead" refers to hollow plastic pigments and the like, that include one or more void(s) within the outer dimension of the pigment volume. The hollow beads can have an inner void volume from about 20% to 70% and about 30% to 60% when the hollow bead is in dry condition. In addition, the hollow beads can have a diameter from about 0.1 to 10 μm, about 0.1 to 5 μm, and about 0.1 to 2 μm. Further, the hollow beads can have a glass transition temperature (Tg) from about 30° C. to 120° C. and preferably from about 60° C. to 120° C. Furthermore, the hollow beads used for a particular application have substantially the same diameter.

The hollow beads can be derived from chemicals such as, but not limited to, styrene monomers, acrylic monomers, methacrylic monomers, isoprene (e.g., latex), acid monomers, non-ionic monoethylenically unsaturated monomers, polyethylenically unsaturated monomer, and combinations thereof.

The acid monomers can include, but are not limited to, acrylic acid, methacrylic acid, and mixtures thereof; and acryloxypropionic acid, methacryloxypropionic acid, acryloxyacetic acid, methacryloxyacetic acid, and monomethyl acid itaconate. The non-ionic monoethylenically unsaturated monomers can include, but are not limited to, styrene and styrene derivatives (e.g. alkyl, chloro- and bromo-containing styrene), vinyltoluene, ethylene, vinyl esters (e.g. vinyl acetate, vinylformate, vinylacetate, vinylpropionate, vinylbenzoate, vinylpivalate, vinyl 2-ethylhexanoate, vinyl methacrylate, vinyl neodecanoate, and vinyl neononanoate), vinyl versatate, vinyl laurate, vinyl stearate, vinyl myristate, vinyl butyrate, vinyl valerate, vinyl chloride, vinylidene chloride, acrylonitrile, methacrylonitrile, acrylamide, (meth)acrylamide, t-butylacrylamide, t-butyl methacrylamide, isopropylarylamide, isopropylmethacrylamide, and $C_1$-$C_{20}$ alkyl or $C_3$-$C_{20}$ alkenyl esters of (meth)acrylic acid.

The expression (meth)acrylic acid is intended to serve as a generic expression embracing both acrylic acid and methacrylic acid (e.g., methyl methacrylate, t-butylmethacrylate, methyl acrylate, ethyl(meth)acrylate, butyl(meth)acrylate, 2-ethylhexyl(meth)acrylate, benzyl(meth)acrylate, lauryl (meth)acrylate, oleyl(meth)acrylate, palmityl(meth)acrylate, stearyl(meth)acrylate, hydroxyl containing (meth)acrylate, (e.g., hydroxyethylacrylate, hydroxyethylmethacrylate, hydroxypropylacrylate, hydroxypropylmethacrylate, and 2,3-Dihydroxypropyl methacrylate)). Polyethylenically unsaturated monomers can include, but are not limited to, ethylene glycol di(meth)acrylate, allyl(meth)acrylate, 1,3-butane-diol di(meth)acrylate, diethylene glycol di(meth) acrylate, trimethylol propane trimethacrylate, and divinyl benzene.

In particular, the hollow beads can include, but are not limited to, an acrylic or styrene acrylic emulsion, such as Ropaque® Ultra, Ropaque® HP-543, Ropaque® HP-643, Ropaque® HP-1055, or Ropaque® OP-96 (available from Rohm and Haas Co. (Philadelphia, Pa.)) or carboxylated styrene/acrylate copolymers (e.g., Dow plastic pigment HS 2000NA, Dow plastic pigment 3000NA), carboxylated styrene/butadiene copolymer (e.g., Dow Latex HSB 3042NA (available from Dow Chemical Co. (Midland, Mich.))).

An amount of binder can be used that functionally binds together the hollow beads, but still leaves space between and within the hollow beads such that ink can be received within the coating/ink receiving layer upon printing. Appropriate ratios of the binder and hollow beads can provide coating/ink receiving layers that avoid unwanted cracking upon drying, and at the same time, provide the hollow beads adhesion within the coating/ink receiving layer while maintaining voids within and around the hollow beads.

In particular, the hollow bead can be about 50 to 99 dry weight % about 55 to 95 dry weight %, about 65 to 90 dry weight %, and about greater than about 65 dry weight % of the coating/ink receiving layer. The binder can be about 1 to 50 dry weight %, about 5 to 45 dry weight %, about 10 to 35 dry weight %, and about less than about 35 dry weight % of the coating/ink receiving layer.

In some embodiments the coating/ink receiving layer may include microporous and/or mesoporous inorganic particles having a large surface area. The microporous and/or mesoporous inorganic particles may be bound in a polymer binder to form the coating/ink receiving layer. The microporous and/or mesoporous inorganic particles may include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boehmite, bentonite, hectorite, clay, and mixtures thereof. The coating/ink receiving layer may be from about 1 μm to 300 μm thick.

In some embodiments the coating/ink receiving layer may also include non-hollow polymer particles to modify the physical properties of the coating/ink receiving layer. The composition of the non-hollow polymer particle can be the same as hollow particles except there is no void inside the particles. The morphology of the non-hollow particles can be homogenous or core-shell. The $T_g$ of the non-hollow particles can be from about −20 to 120° C. and preferably from about −20 to 50° C. The particle size of the non-hollow particles can be from about 0.2 to 5 μm and preferably from about 0.2 to 1 μm. Most preferred compositions of the non-hollow polymer particles suitable as additives include, but are not limited to, polystyrene polymers, poly(styrene-acrylic) copolymers, poly(styrene-methacrylic) copolymers, polyacrylic polymers, polymethacrylic polymers, and polyvinylacetate polymers.

Various biocides can be used to inhibit growth of undesirable microorganisms in the coating/ink receiving layer. Several non-limiting examples of suitable biocides include benzoate salts, sorbate salts, commercial products such as NUOSEPT (Nudex, Inc., a division of Huls America), UCARCIDE (Union Carbide), VANCIDE (RT Vanderbilt Colo.), and PROXEL (ICI Americas) and other known biocides.

In an embodiment, a second coating layer can be disposed on top of the coating/ink receiving layer, where the coating/ink receiving layer is disposed on the substrate. The second coating layer includes, but is not limited to, inorganic pigments and polymeric binders. The coating weight of the second layer can be about 2 to 50 gsm and preferably about 5 to 30 gsm.

The inorganic pigment can include, but not limited to, silica (Si) pigments, aluminum (Al) pigments, calcium carbonate ($CaCO_3$) pigments, or a combination thereof. Si pigments include, but are not limited to, gelled silica, colloid silica, precipitated silica, fumed silica, surface treated silica, and combinations thereof. Al pigments include, but are not limited to, boehmite alumina, gamma alumina, fumed alumina, colloid alumina, or a combination thereof. $CaCO_3$ pigments include, but are not limited to, precipitated calcium carbonate, ground calcium carbonate, or a combination thereof. The inorganic pigment can be about 30 to 80 dry-weight % and preferably about 40 to 70 dry weight %.

The polymeric binders can include, but are not limited to, polyvinyl alcohol, cationic polyvinylalcohol, acetoacetylated polyvinylalcohol, silylated polyvinylalcohol, carboxylated polyvinylalcohol, polyvinyl alcohol-ethylene oxide copolymer, polyvinylpyrrolidone, copolymer of polyvinylacetate and polyvinylpyrrolidone, copolymer of polyvinylalcohol and polyvinylpyrrolidone, cationic polyvinylpyrrolidone, gelain, hydroxyethylcellulose, methyl cellulose, and combinations thereof. The polymeric binder can be about 20 to 70 dry weight % and preferably about 30 to 60 dry weight %.

In an embodiment of the present disclosure, a printable article is provided that includes coating/ink receiving layer disposed on the fabric or canvas. An ink is disposed on the particular portions of the coating/ink receiving layer using ink-jet systems known in the art. The printers used in this invention are HP Photosmart B9180, Hewlett-Packard Company, Palo Alto, Calif., USA.

EXAMPLE 1

A single layer coating lacquer has been prepared with plastic pigment, Ropaque Ultra, and latex binder, Rhoplex 618. Both chemicals are obtained from Rohm and Haas, Philadelphia, Pa. Then, the coating lacquer was applied with the draw down bar to the canvas printable article. The coating ingredients are listed in following Table I.

TABLE I

| Components | dry weight percent |
|---|---|
| Ropaque Ultra | 70% |
| Rhoplex 618 | 30% |

EXAMPLE 2

A single layer coating lacquer has been prepared with plastic pigment, Ropaque Ultra, and latex binders, Rhoplex 618 and Rhoplex K3. All chemicals are obtained from Rohm and Haas, Philadelphia, Pa. Then, the coating lacquer was applied with the draw down bar to the canvas printable article. The coating ingredients are listed in following Table II.

TABLE II

| Components | dry weight percent |
|---|---|
| Ropaque Ultra | 79% |
| Rhoplex 618 | 14% |
| Rhoplex K3 | 7% |

EXAMPLE 3

A single layer coating lacquer has been prepared with plastic pigments, Ropaque Ultra and Ropaque AF1055, latex binder, Rhoplex 618 and surfactant Triton X-100. All Ropaques and Rhoplex chemicals are obtained from Rohm and Haas, Philadelphia, Pa. The Triton X-100 is obtained from Sigma-Aldrich, St. Louis, Mo. Then, the coating lacquer was applied with the draw down bar to the canvas printable article. The coating ingredients are listed in following Table III.

TABLE III

| Components | dry weight percent |
|---|---|
| Ropaque Ultra | 62% |
| Ropaque AF 1055 | 7.5% |
| Roplex 618 | 30% |
| Triton X-100 | 0.5% |

The performance of image quality and cracking for the example 1, 2 and 3 are outlined in Table IV. It was observed that higher pigment percentage provided good image quality but worse cracking. It was, however, the image quality deteriorated when the content of latex binder increased. The coating formulation with good performance in both image quality and cracking was able to be achieved after the coating formulation was optimized.

TABLE IV

| Tested Sample | Image Quailty | Cracking |
|---|---|---|
| Example 1 | 4 | 2.5 |
| Example 2 | 3 | 4 |
| Example 3 | 4 | 4 |

Both image quality and cracking are ranked visually and the score is based on 1 to 5 range, where 5 is the best.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

The above discussion is meant to be illustrative of the principles and various embodiments of the present disclosure.

Numerous variations and modifications will become apparent to those skilled in the art once the above disclosure is fully appreciated. It is intended that the following claims be interpreted to embrace all such variations and modifications.

At least the following is claimed:

1. A printable article, comprising:

a single coating/ink receiving layer disposed on a surface of a woven material, wherein the coating/ink receiving layer includes a plurality of hollow beads and a binder, wherein the binder is selected from acrylic polymers, methacrylic polymers, acrylic-methacrylic copolymers, and combinations thereof, and wherein the single coating/ink receiving layer includes two types of hollow beads.

2. The printable article of claim 1, wherein the hollow beads are selected from styrene polymers, styrene-acrylic copolymers, styrene-methacrylic copolymers, styrene-acrylic-methacrylic copolymers, styrene-butadiene copolymers, styrene-isoprene copolymers, and combinations thereof.

3. The printable article of claim 2, wherein the hollow beads have an inner void volume from about 30 to 60%.

4. The printable article of claim 2, wherein the hollow beads are about 50 to 99 dry weight % of the coating/ink receiving layer.

5. The printable article of claim 1, wherein the binder is about 1 to 50 dry weight % of the coating/ink receiving layer.

6. The printable article of claim 1, wherein coating/ink receiving layer is about 20 to 100 grams per square meter (GSM).

7. The printable article of claim 1, wherein the hollow beads are at least about 50% of the ink-receiving layer.

8. The printable article of claim 1, wherein the hollow beads are about 50 to 99 dry weight % of the coating/ink receiving layer and the binder is about 1 to 50 dry weight % of the coating/ink receiving layer.

9. A printable article, comprising:

a coating/ink receiving layer disposed on a surface of a woven material, wherein the coating/ink receiving layer includes a plurality of hollow beads and a binder, wherein the binder is selected from acrylic polymers, methacrylic polymers, acrylic-methacrylic copolymers, acrylic-methacrylic copolymers, and combinations thereof, and wherein the coating/ink receiving layer includes two types of hollow beads; and a second layer disposed on top of the coating/ink receiving layer, wherein the second layer includes an inorganic pigment and a binder.

10. The printable article of claim 9, wherein the inorganic pigment is selected from: silica pigments, alumina pigments, calcium carbonate pigments, or a combination thereof.

11. The printable article of claim 9, wherein the binder of the second layer is selected from: polyvinyl alcohol, cationic polyvinylalcohol, acetoacetylated polyvinylalcohol, silylated polyvinylalcohol, carboxylated polyvinylalcohol, polyvinyl alcohol-ethylene oxide copolymer, polyvinylpyrrolidone, copolymer of polyvinylacetate and polyvinylpyrrolidone, copolymer of polyvinylalcohol and polyvinylpyrrolidone, cationic polyvinylpyrrolidone, gelain, hydroxyethylcellulose, methyl cellulose, and combinations thereof.

12. The printable article of claim 9, wherein the hollow beads is selected from styrene polymers, styrene-acrylic copolymers, styrene-methacrylic copolymers, styrene-acrylic-methacrylic copolymers, styrene-butadiene copolymers, styrene-isoprene copolymers, and combinations thereof.

13. The printable article of claim 12, wherein the hollow beads are about 50 to 99 dry weight % of the coating/ink receiving layer.

* * * * *